US011145237B2

(12) United States Patent
Seo et al.

(10) Patent No.: US 11,145,237 B2
(45) Date of Patent: Oct. 12, 2021

(54) GATE DRIVER, DISPLAY APPARATUS HAVING THE SAME AND METHOD OF DRIVING DISPLAY PANEL USING THE SAME

(71) Applicant: Samsung Display Co., Ltd., Yongin-si (KR)

(72) Inventors: Hae-Kwan Seo, Hwaseong-si (KR); Myungho Lee, Anyang-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 225 days.

(21) Appl. No.: 16/186,311

(22) Filed: Nov. 9, 2018

(65) Prior Publication Data

US 2019/0164467 A1 May 30, 2019

(30) Foreign Application Priority Data

Nov. 24, 2017 (KR) ..... 10-2017-0158838

(51) Int. Cl.
*G09G 3/36* (2006.01)
*G09G 3/20* (2006.01)
(Continued)

(52) U.S. Cl.
CPC ..... *G09G 3/2092* (2013.01); *G09G 3/3266* (2013.01); *G09G 3/3275* (2013.01); *G09G 3/3677* (2013.01); *G09G 3/3688* (2013.01); *G09G 2310/0243* (2013.01); *G09G 2310/0286* (2013.01); *G09G 2310/0291* (2013.01); *G09G 2310/04* (2013.01); *G09G 2310/08* (2013.01); *G09G 2330/021* (2013.01); *G09G 2340/0435* (2013.01)

(58) Field of Classification Search
CPC ..... G09G 3/3266; G09G 3/3677; G09G 2310/0267; G09G 2310/0283; G09G 2310/0286; G09G 2310/04; G09G 3/3674–3681; G09G 3/2092; G09G 3/3275; G09G 3/3688; G09G 2310/0243; G09G 2310/0291; G09G 2310/08; G09G 2330/021; G09G 2340/0435; G11C 19/188; G11C 19/28–287
USPC ..... 345/100; 377/64–81
See application file for complete search history.

(56) References Cited

U.S. PATENT DOCUMENTS 5,051,739 A * 9/1991 Hayashida ..... G09G 3/3677 345/90
8,760,376 B2 * 6/2014 Koyama ..... G09G 3/3648 345/87
(Continued)

FOREIGN PATENT DOCUMENTS

KR 10-2011-0059093 A 6/2011
KR 10-2012-0079609 A 7/2012
KR 10-2012-0079610 A 7/2012

*Primary Examiner* — Amr A Awad
*Assistant Examiner* — Aaron Midkiff
(74) *Attorney, Agent, or Firm* — Lewis Roca Rothgerber Christie LLP

(57) ABSTRACT

A gate driver includes a plurality of stages, a memory and a selector. The plurality of stages provides a plurality of gate signals to a plurality of gate lines. The memory receives a gate input signal applied to at least one of the stages and outputs the gate input signal as a selection signal. The selector outputs a vertical start signal to a scan start point among the stages based on the selection signal.

19 Claims, 12 Drawing Sheets

(51) Int. Cl.
*G09G 3/3266* (2016.01)
*G09G 3/3275* (2016.01)

(56) References Cited

U.S. PATENT DOCUMENTS

2011/0128259 A1* 6/2011 Suzuki ..... G11C 19/28
345/204
2016/0049208 A1* 2/2016 Zheng ..... G09G 3/3674
345/212
2018/0075808 A1* 3/2018 Yamashita ..... G09G 3/3266

* cited by examiner

GATE DRIVER, DISPLAY APPARATUS HAVING THE SAME AND METHOD OF DRIVING DISPLAY PANEL USING THE SAME

CROSS-REFERENCE TO RELATED APPLICATION

This application claims priority to and the benefit of Korean Patent Application No. 10-2017-0158838, filed on Nov. 24, 2017 in the Korean Intellectual Property Office (KIPO), the content of which is herein incorporated by reference in its entirety.

BACKGROUND

1. Field

Exemplary embodiments of the present inventive concept relate to a gate driver, a display apparatus including the gate driver and a method of driving a display panel using the display apparatus. More particularly, exemplary embodiments of the present inventive concept relate to a gate driver determining a scan start point of a display panel and a display apparatus including the gate driver and a method of driving the display panel using the display apparatus.

2. Description of the Related Art

A display apparatus includes a display panel and a display panel driver. The display panel driver includes a timing controller, a gate driver and a data driver. The timing controller adjusts drive timings of the gate driver and the data driver. The gate driver outputs gate signals to gate lines. The data driver outputs data voltages to data lines.

A related art gate driver includes a plurality of stages which have the same structure. When a first stage of the related art gate driver starts to be driven, carry signals of the stages are sequentially forwarded to next stages so that a last stage of the related art gate driver may be driven.

Thus, driving only a portion of the display panel may not be possible and a scan start point may not be freely set.

SUMMARY

Exemplary aspects of the present inventive concept provide a gate driver determining a scan start point of a display panel.

Exemplary aspects of the present inventive concept also provide a display apparatus including the above-mentioned gate driver.

Exemplary aspects of the present inventive concept also provide a method of driving the display panel using the above-mentioned display apparatus.

In an exemplary embodiment of a gate driver according to the present inventive concept, the gate driver includes a plurality of stages, a memory and a selector. The plurality of stages provides a plurality of gate signals to a plurality of gate lines. The memory receives a gate input signal applied to at least one of the stages and outputs the gate input signal as a selection signal. The selector outputs a vertical start signal to a scan start point among the stages based on the selection signal.

In an exemplary embodiment, the memory may receive the gate input signal during a non-driving period of the stages.

In an exemplary embodiment, the memory may include a first memory which stores a first gate input signal and connected to a first start stage corresponding to a first scan start point and a second memory which stores a second gate input signal and connected to a second start stage corresponding to a second scan start point.

In an exemplary embodiment, the memory may further include a first mode switching element comprising a control electrode to which a mode selection signal is applied, an input electrode to which the first gate input signal is applied and an output electrode connected to the first memory and a second mode switching element comprising a control electrode to which the mode selection signal is applied, an input electrode to which the second gate input signal is applied and an output electrode connected to the second memory.

In an exemplary embodiment, the mode selection signal may turn on the first mode switching element and the second mode switching element in the non-driving period of the stages.

In an exemplary embodiment, the selector may include a first selection switching element including a control electrode connected to the memory, an input electrode to which the vertical start signal is applied and an output electrode connected to a present stage among the stages.

In an exemplary embodiment, the selector may further include a second selection switching element including a control electrode connected to the memory, an input electrode connected to a previous stage among the stages and an output electrode connected to the present stage among the stages.

In an exemplary embodiment, the first selection switching element and the second selection switching element may be alternately and exclusively turned on and off.

In an exemplary embodiment, the selector may further include a third mode switching element including a control electrode to which a mode selection signal is applied, an input electrode to which the vertical start signal is applied and an output electrode connected to the first selection switching element.

In an exemplary embodiment, the gate driver may further include a fourth mode switching element including a control electrode to which a mode selection signal is applied, an input electrode to which the gate input signal is applied and an output electrode connected to the stages.

In an exemplary embodiment, the gate driver may further include a decoder disposed between the memory and the selector. The decoder may decode the selection signal outputted from the memory and may output the decoded selection signal to the selector.

In an exemplary embodiment, the memory may receive a plurality of gate input signals. The gate input signals may include the vertical start signal, a first clock signal and a second clock signal.

In an exemplary embodiment of a display apparatus according to the present inventive concept, the display apparatus includes a gate driver, a data driver and a display panel. The gate driver includes a plurality of stages, a memory and a selector. The plurality of stages provides a plurality of gate signals to a plurality of gate lines. The memory receives a gate input signal applied to at least one of the stages and outputs the gate input signal as a selection signal. The selector outputs a vertical start signal to a scan start point among the stages based on the selection signal. The data driver outputs a plurality of data voltages to a plurality of data lines. The display panel displays an image based on the gate signals and the data voltages.

In an exemplary embodiment, the memory may receive the gate input signal during a non-driving period of the stages.

In an exemplary embodiment, the memory may receive a first gate input signal, a second gate input signal and a third gate input signal. The selector may output the vertical start signal to one of a first start stage corresponding to a first scan start point of the display panel, a second start stage corresponding to a second scan start point of the display panel and a third start stage corresponding to a third scan start point of the display panel based on the first gate input signal, the second gate input signal and the third gate input signal.

In an exemplary embodiment, the memory may receive a first gate input signal, a second gate input signal, a third gate input signal and a fourth gate input signal. The selector may output the vertical start signal to one of a first start stage corresponding to a first scan start point of the display panel, a second start stage corresponding to a second scan start point of the display panel, a third start stage corresponding to a third scan start point of the display panel and a fourth start stage corresponding to a fourth scan start point of the display panel based on the first gate input signal, the second gate input signal, the third gate input signal and the fourth gate input signal.

In an exemplary embodiment, the gate driver may further include a decoder disposed between the memory and the selector. The decoder may decode the selection signal outputted from the memory and may output the decoded selection signal to the selector.

In an exemplary embodiment, the memory may receive a first gate input signal, a second gate input signal and a third gate input signal. The decoder may generate a decoded selection signal based on the first gate input signal, the second gate input signal and the third gate input signal. The selector may output the vertical start signal to one of a first start stage corresponding to a first scan start point of the display panel, a second start stage corresponding to a second scan start point of the display panel, a third start stage corresponding to a third scan start point of the display panel, a fourth start stage corresponding to a fourth scan start point of the display panel, a fifth start stage corresponding to a fifth scan start point of the display panel, a sixth start stage corresponding to a sixth scan start point of the display panel, a seventh start stage corresponding to a seventh scan start point of the display panel and an eighth start stage corresponding to an eighth scan start point of the display panel based on the decoded selection signal.

In an exemplary embodiment of a method of driving a display panel according to the present inventive concept, the method includes receiving a gate input signal in a memory, the gate input signal applied to at least one of a plurality of stages of a gate driver, outputting the gate input signal as a selection signal, determining a scan start point among the stages based on the gate input signal, outputting gate signals to the display panel from the scan start point, outputting data voltages to the display panel and outputting an image based on the gate signals and the data voltages.

In an exemplary embodiment, the memory may receive the gate input signal during a non-driving period of the stages.

According to the gate driver, the display apparatus including the gate driver and the method of driving the display panel using the display apparatus, the scan start point may be determined using an input signal of the gate driver.

In a low frequency driving method, the portion of the display panel which has changing images may be selectively updated by changing data so that the power consumption may be reduced.

In addition, a display quality compensation and a lifetime compensation may be applied to only a portion of the display panel so that the display quality of the display panel may be enhanced and the time and the power consumption for the display quality compensation and the lifetime compensation may be reduced.

BRIEF DESCRIPTION OF THE DRAWINGS

The above and other features and advantages of the present inventive concept will become more apparent by describing in detailed exemplary embodiments thereof with reference to the accompanying drawings, in which.

DETAILED DESCRIPTION

Hereinafter, the present inventive concept will be explained in detail with reference to the accompanying drawings.

Figure 1:
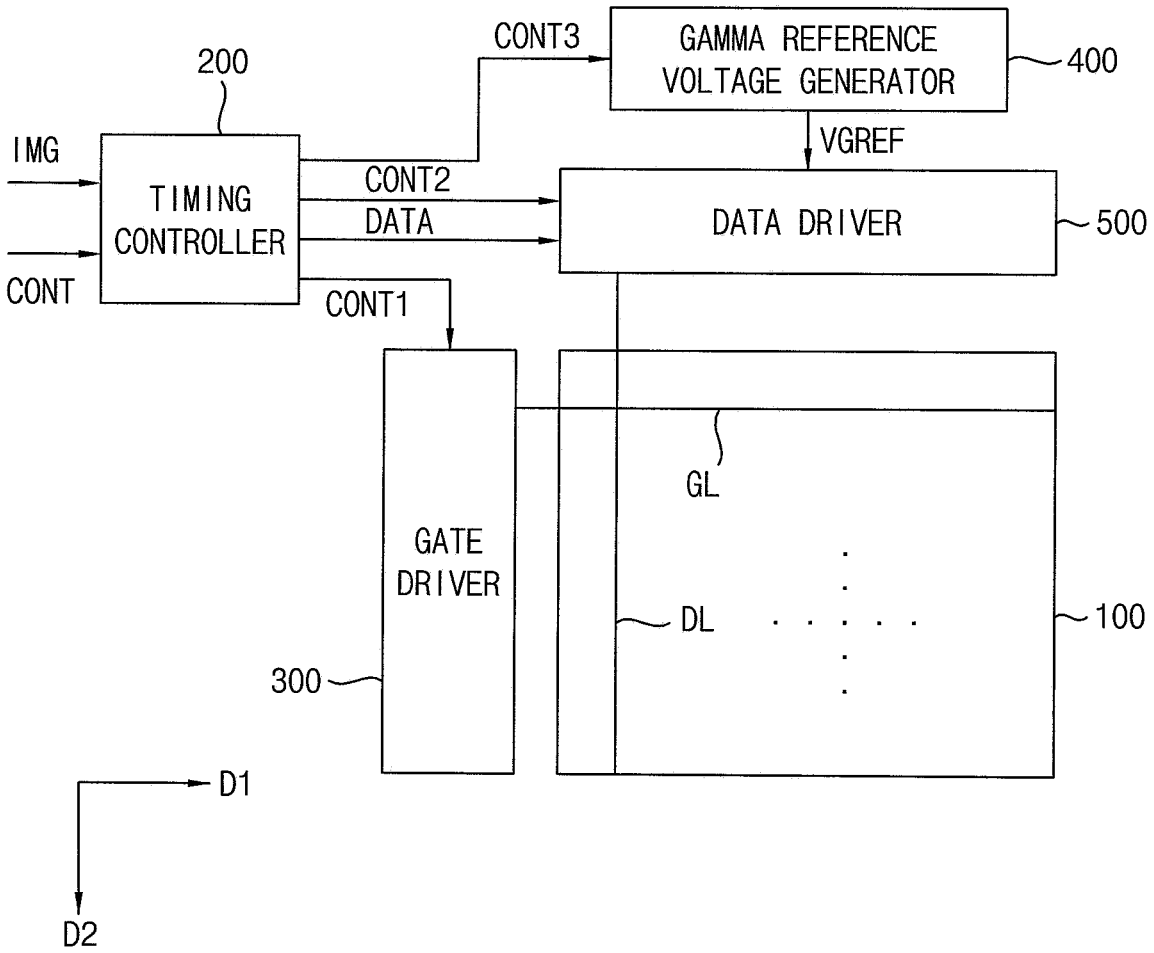
FIG. 1 is a block diagram illustrating a display apparatus according to an exemplary embodiment of the present inventive concept.

FIG. 1 is a block diagram illustrating a display apparatus according to an exemplary embodiment of the present inventive concept.

Referring to FIG. 1, the display apparatus includes a display panel 100 and a display panel driver. The display panel driver includes a timing controller 200, a gate driver 300, a gamma reference voltage generator 400 and a data driver 500.

The display panel 100 includes a display region and a peripheral region adjacent to the display region. For example, the display panel 100 may be an organic light emitting display panel including an organic light emitting diode. Alternatively, the display panel 100 may be a liquid crystal display panel including a liquid crystal layer.

The display panel 100 includes a plurality of gate lines GL, a plurality of data lines DL and a plurality of pixels electrically connected to the gate lines GL and the data lines DL. The gate lines GL extend in a first direction D1, and the data lines DL extend in a second direction D2 crossing the first direction D1.

The timing controller 200 receives input image data IMG and an input control signal CONT from an external apparatus. The input image data IMG may include red image data, green image data and blue image data. The input control signal CONT may include a master clock signal and a data enabled signal. The input control signal CONT may further include a vertical synchronizing signal and a horizontal synchronizing signal.

Based on the input image data IMG and the input control signal CONT, the timing controller 200 generates a first control signal CONT1, a second control signal CONT2, a third control signal CONT3 and a data signal DATA.

The timing controller 200 generates the first control signal CONT1 for controlling an operation of the gate driver 300 based on the input control signal CONT, and outputs the first control signal CONT1 to the gate driver 300. The first control signal CONT1 may include a vertical start signal and a gate clock signal.

The timing controller 200 generates the second control signal CONT2 for controlling an operation of the data driver 500 based on the input control signal CONT, and outputs the second control signal CONT2 to the data driver 500. The second control signal CONT2 may include a horizontal start signal and a load signal.

The timing controller 200 generates the data signal DATA based on the input image data IMG. The timing controller 200 outputs the data signal DATA to the data driver 500.

The timing controller 200 generates the third control signal CONT3 for controlling an operation of the gamma reference voltage generator 400 based on the input control signal CONT, and outputs the third control signal CONT3 to the gamma reference voltage generator 400.

The gate driver 300 generates gate signals driving the gate lines GL in response to the first control signal CONT1 received from the timing controller 200. For example, the gate driver 300 may sequentially output the gate signals to the gate lines GL.

The gate driver 300 may be directly mounted on the display panel 100 or may be connected to the display panel 100 through a tape carrier package ("TCP"). Alternatively, the gate driver 300 may be integrated in the peripheral region of the display panel 100.

The structure and the operation of the gate driver 300 may be explained in accordance with to FIGS. 2 to 7 in more detail.

The gamma reference voltage generator 400 generates a gamma reference voltage VGREF in response to the third control signal CONT3 received from the timing controller 200. The gamma reference voltage generator 400 provides the gamma reference voltage VGREF to the data driver 500. The gamma reference voltage VGREF has a value corresponding to a level of the data signal DATA.

In an exemplary embodiment, the gamma reference voltage generator 400 may be disposed in the timing controller 200, or in the data driver 500.

The data driver 500 receives the second control signal CONT2 and the data signal DATA from the timing controller 200, and receives the gamma reference voltages VGREF from the gamma reference voltage generator 400. The data driver 500 converts the data signal DATA into data voltages having an analog type using the gamma reference voltages VGREF. The data driver 500 outputs the data voltages to the data lines DL.

For example, the timing controller 200, the gamma reference voltage generator 400 and the data driver 500 may be formed as a single chip.

Figure 2:
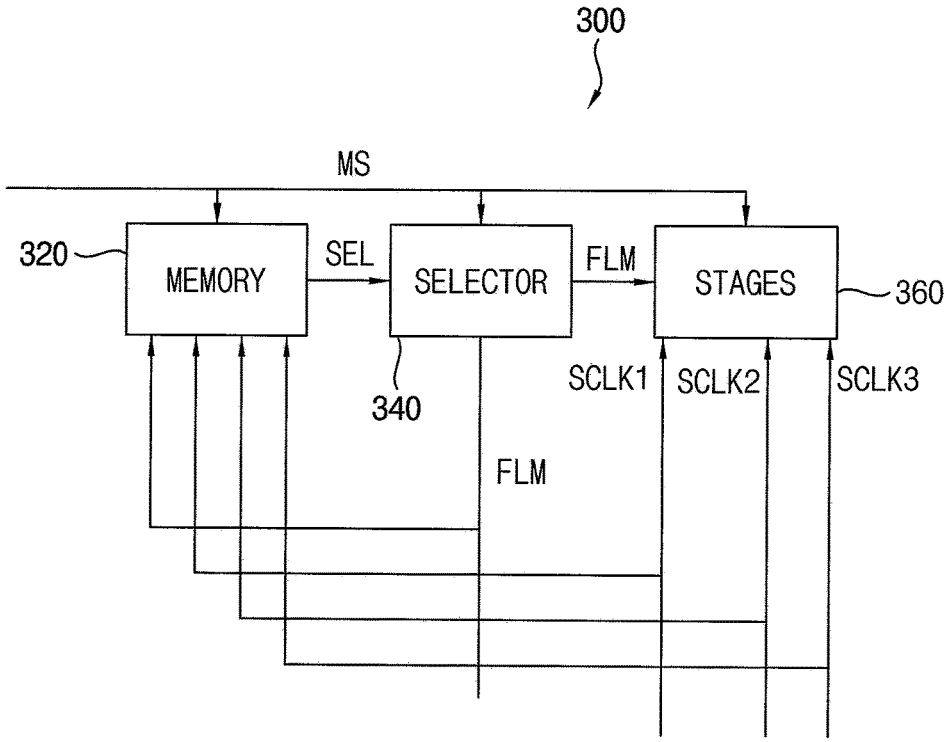
FIG. 2 is a block diagram illustrating a gate driver of FIG. 1.
Figure 3:
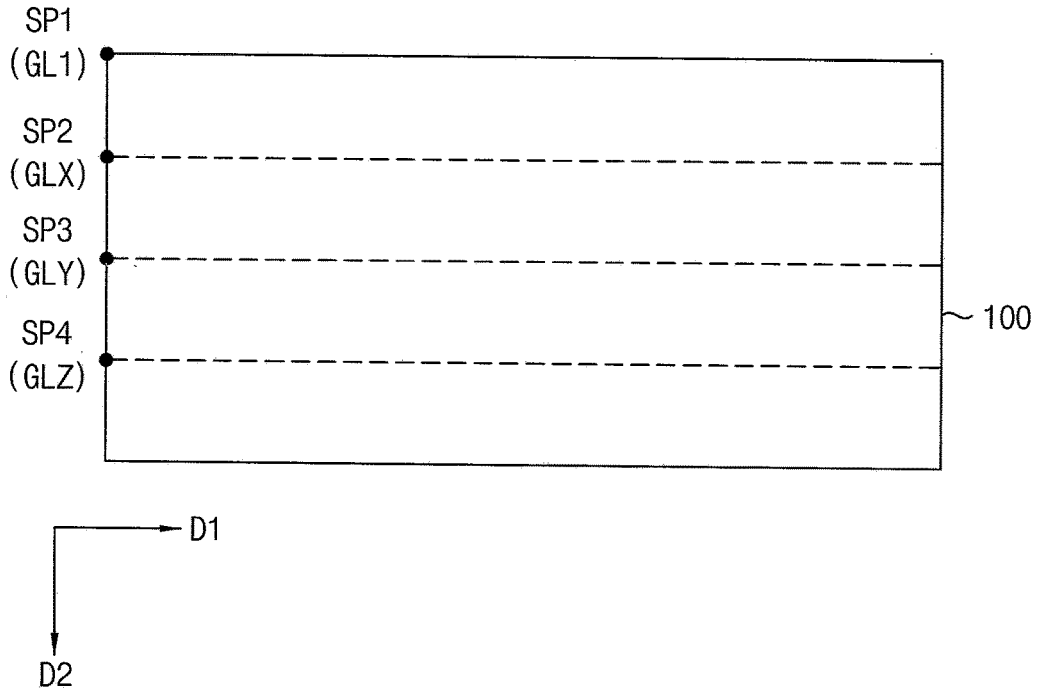
FIG. 3 is a conceptual diagram illustrating a scan start point of a display panel of FIG. 1.
Figure 4:
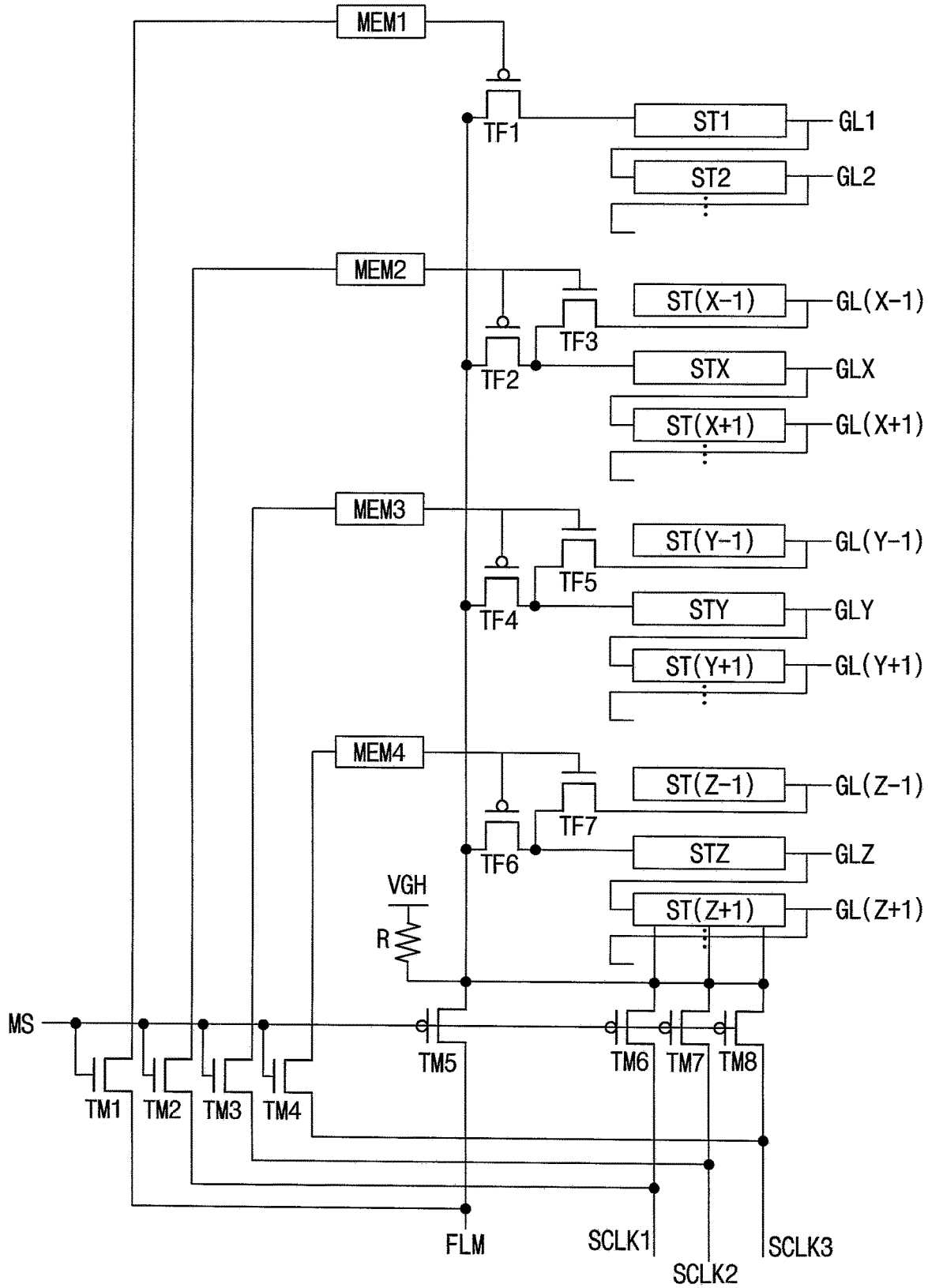
FIG. 4 is a circuit diagram illustrating the gate driver of FIG. 1.
Figure 5:
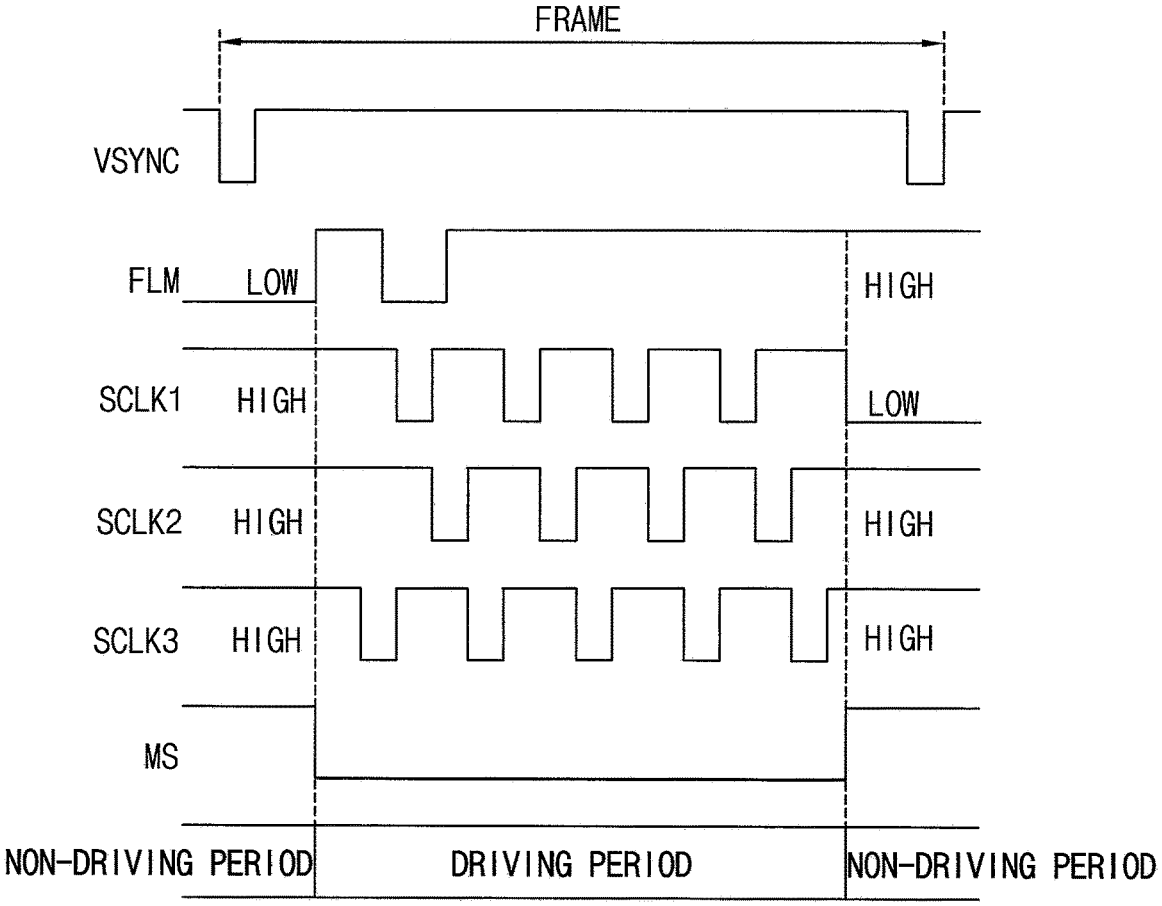
FIG. 5 is a timing diagram illustrating signals applied to the gate driver of FIG. 4.

FIG. 2 is a block diagram illustrating the gate driver 300 of FIG. 1. FIG. 3 is a conceptual diagram illustrating a scan start point of the display panel 100 of FIG. 1. FIG. 4 is a circuit diagram illustrating the gate driver 300 of FIG. 1. FIG. 5 is a timing diagram illustrating signals applied to the gate driver 300 of FIG. 4.

Referring to FIGS. 1 to 5, the gate driver 300 includes a memory 320, a selector 340 and a plurality of stages 360.

The stages 360 outputs the gate signals to the gate lines GL.

The memory 320 receives a gate input signal applied to at least one of the stages 360, and outputs the gate input signal as a selection signal SEL to the selector 340.

The memory 320 may receive the gate input signal during a non-driving period of the stages 360. The memory 320 may receive the gate input signal during the non-driving period of the stages 360 based on the mode selection signal MS. The memory 320 may output the gate input signal as the selection signal SEL to the selector 340 regardless of the driving period and the non-driving period of the stages 360.

The selector 340 outputs the vertical start signal FLM to the scan start point among the stages based on the selection signal SEL. The selector 340 may output the vertical start signal FLM to the scan start point among the stages during the driving period of the stages 360. The selector 340 may output the vertical start signal FLM to the scan start point among the stages during the driving period of the stages 360 based on the mode selection signal MS.

The memory 320 may receive a first gate input signal, a second gate input signal, a third gate input signal and a fourth gate input signal and the selector 340 may output the vertical start signal FLM to one of a first start stage corresponding to a first scan start point SP1 of the display panel 100, a second start stage corresponding to a second scan start point SP2 of the display panel 100, a third start stage corresponding to a third scan start point SP3 of the display panel 100 and a fourth start stage corresponding to a fourth scan start point SP4 of the display panel 100 based on the first gate input signal, the second gate input signal, the third gate input signal and the fourth gate input signal.

In the present exemplary embodiment, the first to fourth gate input signals may be respectively the vertical start signal FLM, a first clock signal SCLK1, a second clock signal SCLK2 and a third clock signal SCLK3. The memory 320 may receive the vertical start signal FLM, the first clock signal SCLK1, the second clock signal SCLK2 and the third clock signal SCLK3.

Although the first to fourth gate input signals are respectively the vertical start signal FLM, the first clock signal SCLK1, the second clock signal SCLK2 and the third clock signal SCLK3 in the present exemplary embodiment, the present inventive concept is not limited thereto. Alternatively, the memory 320 may receive other input signals applied to the gate driver 300.

The memory 320 may include a first memory MEM1 storing the first gate input signal FLM and connected to the first start stage ST1 corresponding to the first scan start point SP1, a second memory MEM2 storing the second gate input signal SCLK1 and connected to the second start stage STX corresponding to the second scan start point SP2, a third memory MEM3 storing the third gate input signal SCLK2 and connected to the third start stage STY corresponding to the third scan start point SP3 and a fourth memory MEM4 storing the fourth gate input signal SCLK3 and connected to the fourth start stage STZ corresponding to the fourth scan start point SP4.

The memory 320 may include a first mode switching element TM1 including a control electrode to which the mode selection signal MS is applied, an input electrode to which the first gate input signal FLM is applied and an output electrode connected to the first memory MEM1, a second mode switching element TM2 including a control electrode to which the mode selection signal MS is applied, an input electrode to which the second gate input signal SCLK1 is applied and an output electrode connected to the second memory MEM2, a third mode switching element TM3 including a control electrode to which the mode selection signal MS is applied, an input electrode to which the third gate input signal SCLK2 is applied and an output electrode connected to the third memory MEM3 and a fourth mode switching element TM4 including a control electrode to which the mode selection signal MS is applied, an input electrode to which the fourth gate input signal SCLK3 is applied and an output electrode connected to the fourth memory MEM4.

The mode selection signal MS has a high level during the non-driving period. The first to fourth mode switching element TM1, TM2, TM3 and TM4 may be turned on by the high level of the mode selection signal MS. When the first to fourth mode switching element TM1, TM2, TM3 and TM4 are turned on, the first to fourth gate input signals FLM, SCLK1, SCLK2 and SCLK3 may be stored in the corresponding first to fourth memories MEM1, MEM2, MEM3 and MEM4. Each of the first to fourth memories MEM1, MEM2, MEM3 and MEM4 may be one-bit memory.

Although the memory 320 includes four one-bit memories MEM1, MEM2, MEM3 and MEM4 to store the first to fourth gate input signals FLM, SCLK1, SCLK2 and SCLK3 in the present exemplary embodiment, the present inventive concept is not limited thereto. Alternatively, the memory 320 may include a multi-bit memory to store the first to fourth gate input signals FLM, SCLK1, SCLK2 and SCLK3. Alternatively, the memory 320 may include a plurality of multi-bit memories to store the first to fourth gate input signals FLM, SCLK1, SCLK2 and SCLK3.

The selector 340 includes a first selection switching element (e.g. TF1, TF2, TF4 and TF6) including a control electrode connected to the memory 320, an input electrode to which the vertical start signal FLM is applied and an output electrode connected to a present stage (e.g. ST1, STX, STY and STZ) among the stages.

For example, the output electrode of the first selection switching element (e.g. TF1, TF2, TF4 and TF6) may be connected to a carry input terminal (S[N-1] in FIG. 6) of the present stage (e.g. ST1, STX, STY and STZ).

The selector 340 may further include a second selection switching element (e.g. TF3, TF5 and TF7) including a control electrode connected to the memory 320, an input electrode connected to a previous stage (e.g. STX-1, STY-1 and STZ-1) among the stages and an output electrode connected to the present stage (e.g. STX, STY and STZ) among the stages.

For example, the input electrode of the second selection switching element (e.g. TF3, TF5 and TF7) may be connected to an output stage (S[N] in FIG. 6) of the previous stage (e.g. STX-1, STY-1 and STZ-1).

For example, the output electrode of the second selection switching element (e.g. TF3, TF5 and TF7) may be connected to the carry input terminal (S[N-1] in FIG. 6) of the present stage (e.g. ST1, STX, STY and STZ).

As shown in FIG. 4, the first stage may not include the second selection switching element (e.g. TF3, TF5 and TF7).

The first selection switching element (e.g. TF2, TF4 and TF6) and the second selection switching element (e.g. TF3, TF5 and TF7) may be alternately and exclusively turned on and off.

For example, when the signal outputted from the memory 320 has a low level, the first selection switching element (e.g. TF2, TF4 and TF6) among the first selection switching element (e.g. TF2, TF4 and TF6) and the second selection switching element (e.g. TF3, TF5 and TF7) is turned on so that the vertical start signal FLM may be output to the present stage (e.g. STX, STY and STZ).

For example, when the signal outputted from the memory 320 has a high level, the second selection switching element (e.g. TF3, TF5 and TF7) among the first selection switching element (e.g. TF2, TF4 and TF6) and the second selection switching element (e.g. TF3, TF5 and TF7) is turned on so that the carry signal of the previous stage (e.g. STX-1, STY-1 and STZ-1) may be output to the present stage (e.g. STX, STY and STZ).

For example, when the output signal of the first memory MEM1 has a low level and the output signals of the second to fourth memories MEM2, MEM3 and MEM4 have a high level, the vertical start signal FLM is applied to the first start stage ST1 connected to the first memory MEM1 and the carry signals of the previous stages are applied to the second to fourth start stages STX, STY and STZ so that the display panel 100 is driven from the first scan start point ST1 to the last stage of the display panel 100.

For example, when the output signal of the second memory MEM2 has a low level and the output signals of the first, third and fourth memories MEM1, MEM3 and MEM4 have a high level, the vertical start signal FLM is applied to the second start stage STX connected to the second memory MEM2 and the carry signals of the previous stages are applied to the third and fourth start stages STY and STZ so that the display panel 100 is driven from the second scan start point STX to the last stage of the display panel 100. Herein, a signal having a high level may be applied to the carry input terminal of the first start stage ST1.

For example, when the output signal of the third memory MEM3 has a low level and the output signals of the first, second and fourth memories MEM1, MEM2 and MEM4 have a high level, the vertical start signal FLM is applied to the third start stage STY connected to the third memory MEM3 and the carry signals of the previous stages are applied to the second and fourth start stages STX and STZ so that the display panel 100 is driven from the third scan start point STY to the last stage of the display panel 100. Herein, a signal having a high level may be applied to the carry input terminal of the first start stage ST1.

For example, when the output signal of the fourth memory MEM4 has a low level and the output signals of the first to third memories MEM1, MEM2 and MEM3 have a high level, the vertical start signal FLM is applied to the fourth start stage STZ connected to the fourth memory MEM4 and the carry signals of the previous stages are applied to the second and third start stages STX and STY so that the display panel 100 is driven from the fourth scan start point STZ to the last stage of the display panel 100. Herein, a signal having a high level may be applied to the carry input terminal of the first start stage ST1.

In FIG. 5, for example, the vertical start signal FLM having a low level may be stored in the first memory MEM1 and the first to third clock signals SCLK1, SCLK2 and SCLK3 having a high level may be stored in the second to fourth memories MEM2, MEM3 and MEM4 during the first non-driving period. During the driving period right after the first non-driving period, the display panel 100 may be scanned from the first scan start point (SP1=ST1) by the vertical start signal FLM having the low level.

For example, the first clock signal SCLK1 having a low level may be stored in the second memory MEM2 and the vertical start signal FLM and the second and third clock signals SCLK2 and SCLK3 having a high level may be stored in the first, third and fourth memories MEM1, MEM3 and MEM4 during a second non-driving period. During the driving period right after the second non-driving period, the display panel 100 may be scanned from the second scan start point (SP2=STX) by the first clock signal SCLK1 having the low level.

A time duration between rising edges of the vertical synchronizing signal VSYNC in FIG. 5 may be defined as a frame. When levels of the first to fourth gate input signals FLM, SCLK1, SCLK2 and SCLK3 are adjusted in every frame, the scan start point of the display panel 100 may be set in every frame.

Although the first to fourth gate input signals FLM, SCLK1, SCLK2 and SCLK3 have a single level of the low high level or the low level in the single non-driving period in FIG. 5, the present inventive concept is not limited thereto. The first to fourth gate input signals FLM, SCLK1, SCLK2 and SCLK3 may represent the low level or the high level in a plurality of sub periods in the single non-driving period. Accordingly, the single gate input signal may generate the selection signal having multi-bits in the single non-driving period. When the single gate input signal generates the selection signal having multi-bits in the single non-driving period, the scan start points of the display panel 100 more than four may be set using the four gate input signals. For example, when the single gate input signal generates the selection signal having multi-bits in the single non-driving period, the scan start points of the display panel 100 may be set in every gate line.

The selector 340 may further include a fifth mode switching element TM5 including a control electrode to which the mode selection signal MS is applied, an input electrode to which the vertical start signal FLM is applied and an output electrode connected to the first selection switching element (e.g. TF1, TF2, TF4 and TF6).

When the mode selection signal MS has a low level, the fifth mode switching element TM5 is turned on so that the vertical start signal FLM may be applied to the selector 340. For example, when the mode selection signal MS has a low level, this refers to the driving period of the stages 360.

The selector 340 may further include a resistor R to set an initial value (e.g. VGH) of a transmitting line of the vertical start signal FLM when the fifth mode switching element TM5 is turned off. Alternatively, the selector 340 may further include a switching element to set the initial value (e.g. VGH) of the transmitting line of the vertical start signal FLM when the fifth mode switching element TM5 is turned off.

The gate driver 300 may further include a sixth mode switching element TM6, a seventh mode switching element TM7 and an eighth mode switching element TM8. The sixth mode switching element TM6 includes a control electrode to which the mode selection signal MS is applied, an input electrode to which the first clock signal SCLK1 is applied and an output electrode connected to the stages. The seventh mode switching element TM7 includes a control electrode to which the mode selection signal MS is applied, an input electrode to which the second clock signal SCLK2 is applied and an output electrode connected to the stages. The eighth mode switching element TM8 includes a control electrode to which the mode selection signal MS is applied, an input electrode to which the third clock signal SCLK3 is applied and an output electrode connected to the stages.

When the mode selection signal MS has a low level, the sixth to eighth mode switching elements TM6, TM7 and TM8 are turned on so that the sixth to eighth mode switching elements TM6, TM7 and TM8 may apply the first to third clock signals SCLK1, SCLK2 and SCLK3. For example, when the mode selection signal MS has a low level, this refers to the driving period of the stages 360.

In one embodiment, the first to third clock signals SCLK1, SCLK2 and SCLK3 may be applied to each stage and the first to third clock signals SCLK1, SCLK2 and SCLK3 may be alternately applied to the stages.

For example, the first clock signal SCLK1, the second clock signal SCLK2 and the third clock signal SCLK3 may be respectively applied to a first clock terminal, a second clock terminal and a third clock terminal of the first stage. For example, the second clock signal SCLK2, the third clock signal SCLK3 and the first clock signal SCLK1 may be respectively applied to a first clock terminal, a second clock terminal and a third clock terminal of the second stage. For example, the third clock signal SCLK3, the first clock signal SCLK1 and the second clock signal SCLK2 may be respectively applied to a first clock terminal, a second clock terminal and a third clock terminal of the third stage. For example, the first clock signal SCLK1, the second clock signal SCLK2 and the third clock signal SCLK3 may be respectively applied to a first clock terminal, a second clock terminal and a third clock terminal of the fourth stage.

Figure 6:
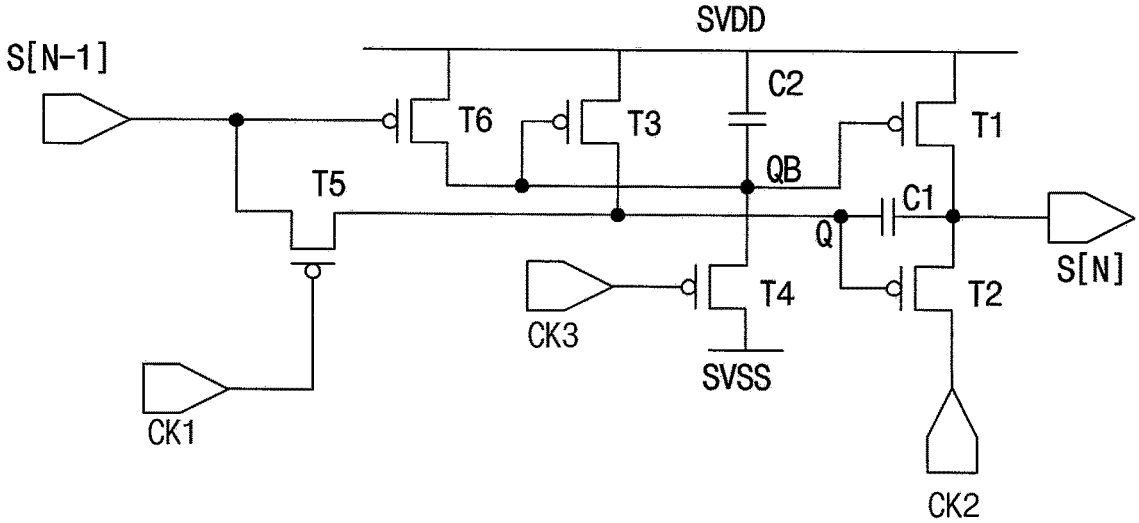
FIG. 6 is a circuit diagram illustrating an N-th stage of the gate driver of FIG. 4.

FIG. 6 is a circuit diagram illustrating an N-th stage STN of the gate driver 300 of FIG. 4.

Referring to FIGS. 1 to 6, the N-th stage STN may include six scan switching elements T1 to T6 and two capacitors C1 and C2.

A first scan switching element T1 includes a control electrode connected to a first node QB, an input electrode to which a first power voltage SVDD is applied and an output electrode connected to an output terminal S[N].

A second scan switching element T2 includes a control electrode connected to a second node Q, an input electrode connected to the output terminal S[N] and an output electrode connected to a second clock input terminal CK2.

A third scan switching element T3 includes a control electrode connected to the first node QB, an input electrode to which the first power voltage SVDD is applied and an output electrode connected to the second node Q.

A fourth scan switching element T4 includes a control electrode connected to a third clock input terminal CK3, an input electrode connected to the first node QB and an output electrode to which a second power voltage SVSS is applied.

A fifth scan switching element T5 includes a control electrode connected to a first clock input terminal CK1, an input electrode connected to a carry input terminal S[N-1] and an output electrode connected to the second node Q.

A sixth scan switching element T6 includes a control electrode connected to the carry input terminal S[N-1], an input electrode to which the first power voltage SVDD is applied and an output electrode connected to the first node QB.

A first capacitor C1 is disposed between the second node Q and the output terminal S[N]. A second capacitor C2 is disposed between the first power voltage SVDD and the first node QB.

The present inventive concept is not limited to the circuit structure of the stage of the gate driver in FIG. 6. The present inventive concept may be applied to circuit structures different from the circuit structure of the stage of the gate driver in FIG. 6.

Figure 7:
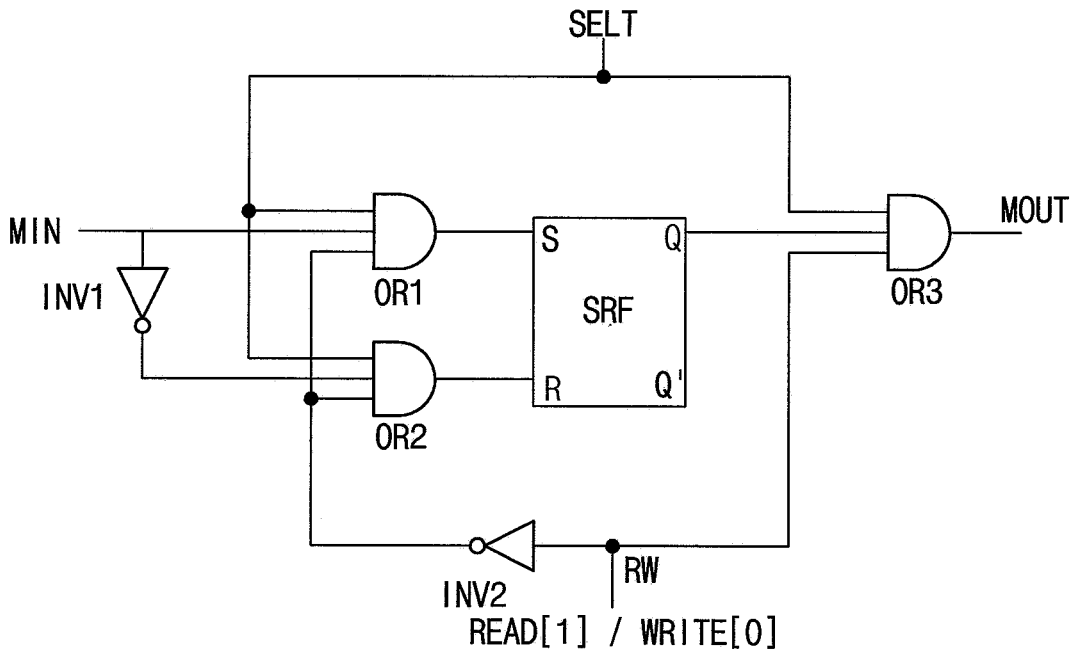
FIG. 7 is a circuit diagram illustrating a memory of FIG. 4.

FIG. 7 is a circuit diagram illustrating a memory (e.g. MEM1) of FIG. 4.

Referring to FIGS. 1 to 7, the memory includes three OR gates, two inverters and a RS latch SRF.

A first OR gate OR1 includes a first input terminal connected to a selection terminal SELT, a second input terminal to which an input signal MIN is applied, a third input terminal connected to a second inverter INV2 and an output terminal connected to a set terminal S of the RS latch SRF.

A second OR gate OR2 includes a first input terminal connected to the selection terminal SELT, a second input terminal connected to a first inverter INV1, a third input terminal connected to the second inverter INV2 and an output terminal connected to a reset terminal RS of the RS latch SRF.

A third OR gate OR3 includes a first input terminal connected to the selection terminal SELT, a second input terminal connected to a Q terminal of the RS latch SRF, a third input terminal connected to a read/write terminal RW and an output terminal outputting an output signal MOUT.

The first inverter INV1 may be disposed between the second input terminal of the first OR gate OR1 and the second input terminal of the second OR gate OR2.

The second inverter INV2 may be disposed between the read/write terminal RW and the third input terminal of the second OR gate OR2.

According to the present exemplary embodiment, the scan start point SP1, SP2, SP3 and SP4 may be set using the input signals FLM, SCLK1, SCLK2 and SCLK3 of the gate driver 300.

Using the above technical features, the data corresponding to an area of a changing image may be selectively updated in a low frequency driving method so that the power consumption may be reduced.

In addition, the display quality compensation and the lifetime compensation may be applied to a specific portion of the display panel 100 so that the display quality of the display panel 100 may be enhanced and the power consumption may be reduced.

Figure 8:
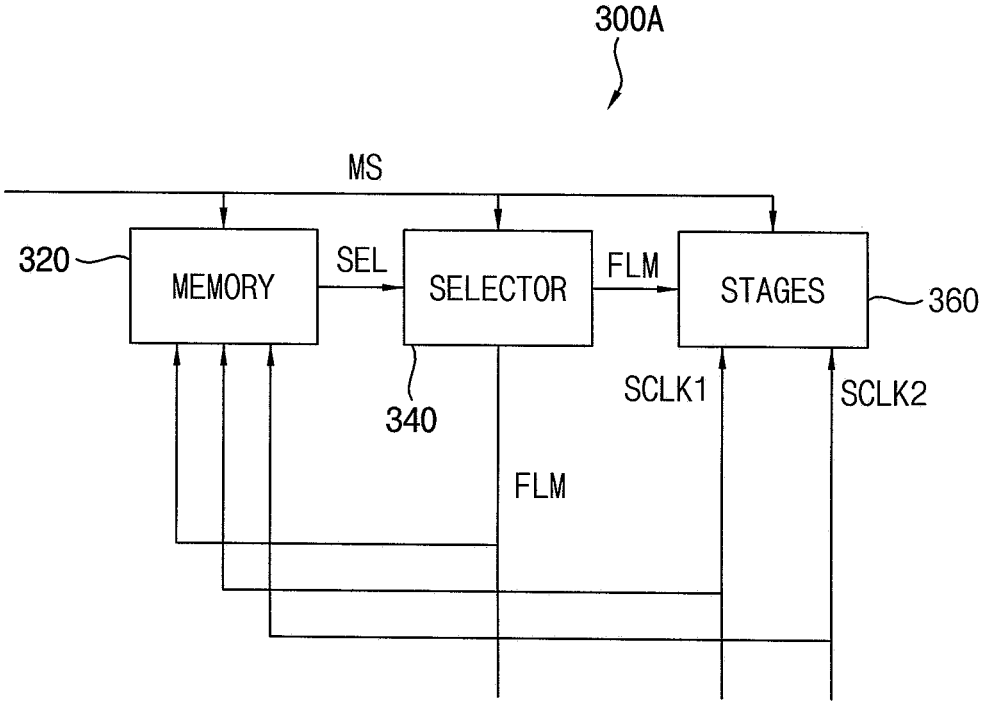
FIG. 8 is a block diagram illustrating a gate driver of a display apparatus according to an exemplary embodiment of the present inventive concept.
Figure 9:
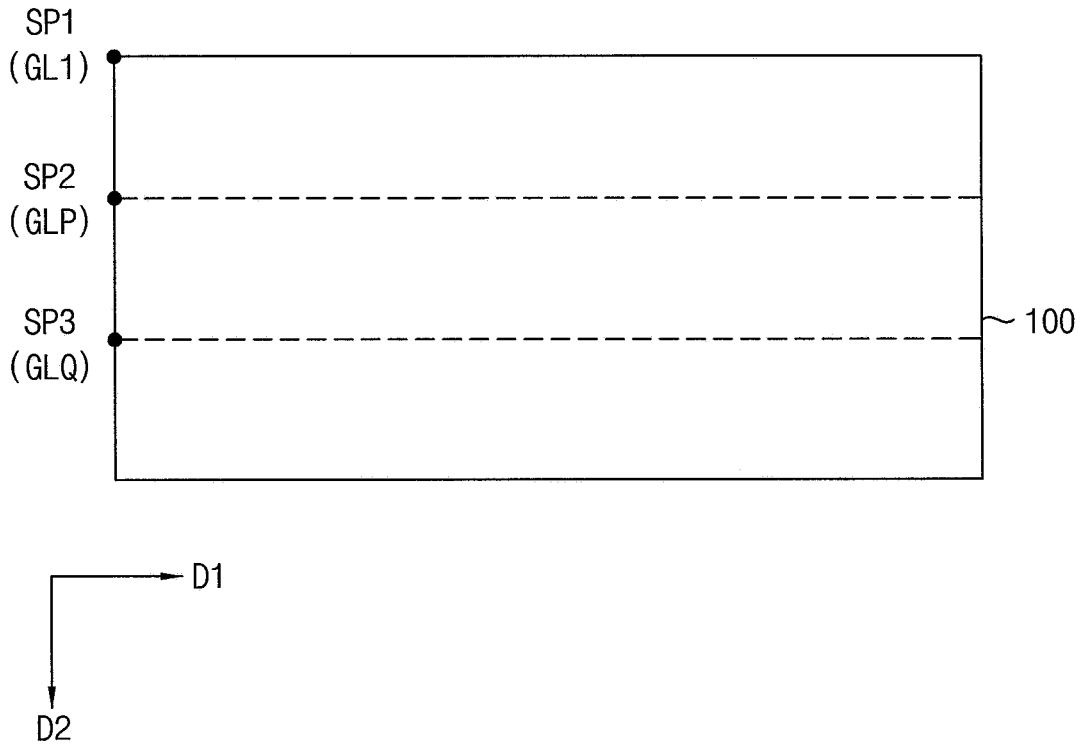
FIG. 9 is a conceptual diagram illustrating a scan start point of a display panel of FIG. 8.
Figure 10:
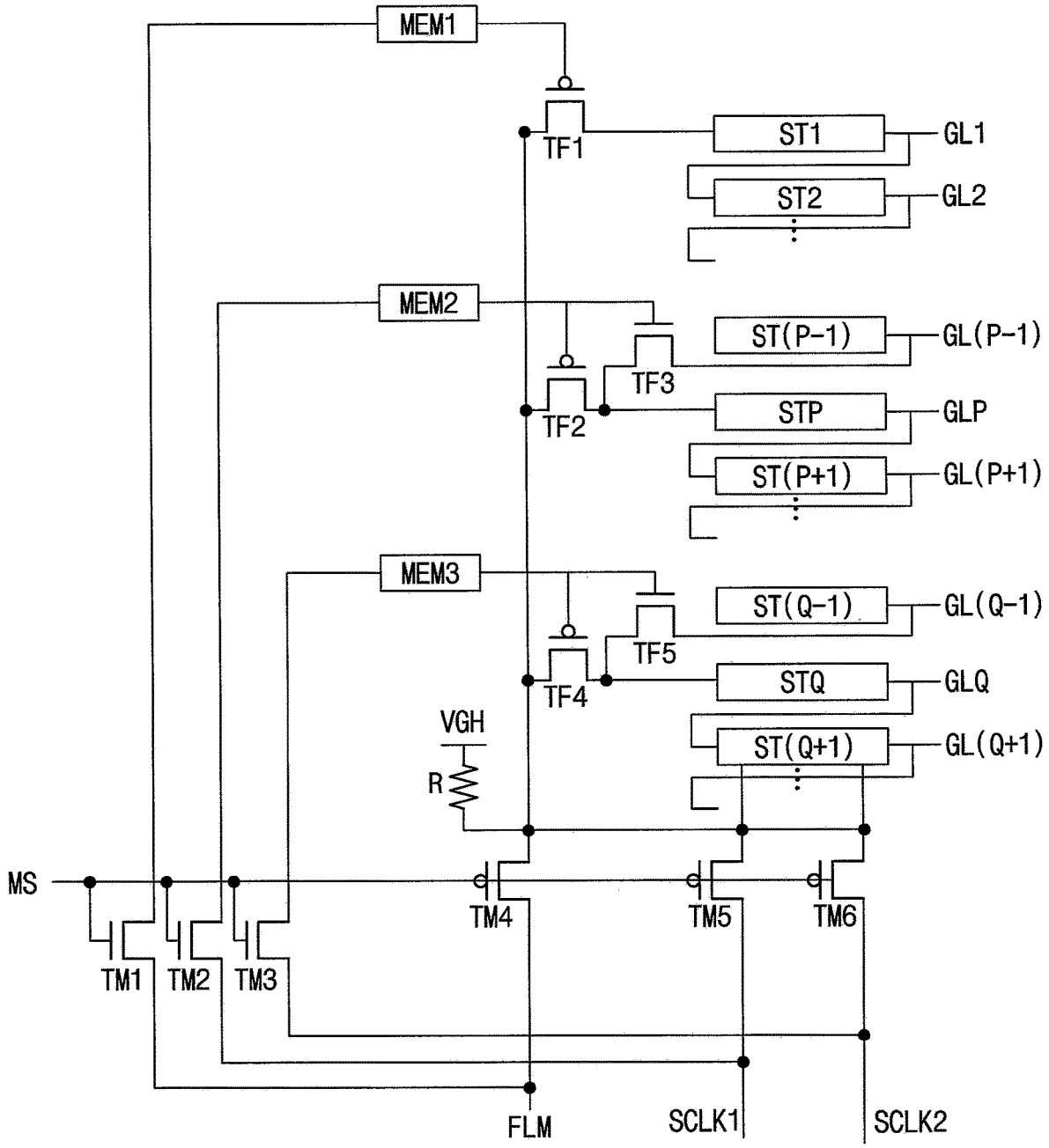
FIG. 10 is a circuit diagram illustrating the gate driver of FIG. 8.
Figure 11:
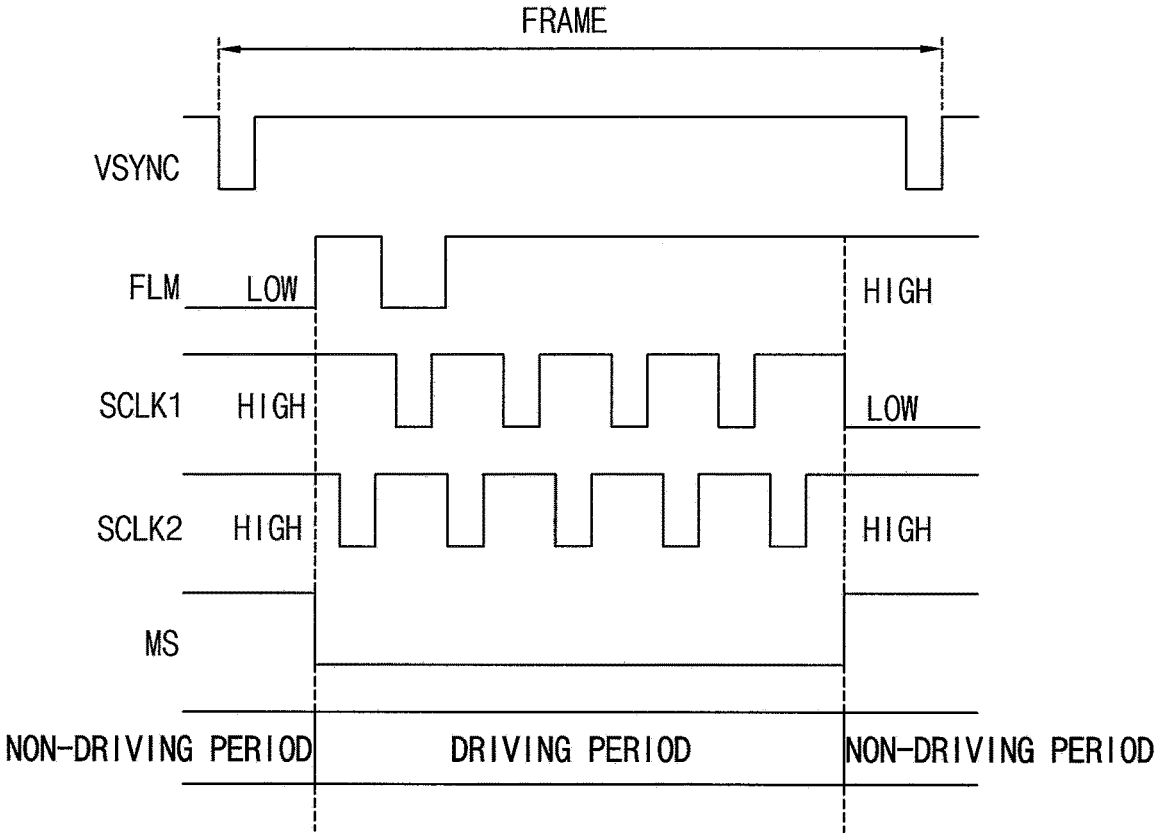
FIG. 11 is a timing diagram illustrating signals applied to the gate driver of FIG. 10.

FIG. 8 is a block diagram illustrating a gate driver of a display apparatus according to an exemplary embodiment of the present inventive concept. FIG. 9 is a conceptual diagram illustrating a scan start point of a display panel of FIG. 8. FIG. 10 is a circuit diagram illustrating the gate driver of FIG. 8. FIG. 11 is a timing diagram illustrating signals applied to the gate driver of FIG. 10.

The display apparatus according to the present exemplary embodiment is substantially the same as the display apparatus of the previous exemplary embodiment explained in accordance with FIGS. 1 to 7 except for the structure of the gate driver and the signals applied to the gate driver. Thus, the same reference numerals will be used to refer to the same or like parts as those described in the previous exemplary embodiment of FIGS. 1 to 7 and any repetitive explanation concerning the above elements will be omitted.

Referring to FIGS. 1 and 8 to 11, the display apparatus includes a display panel 100 and a display panel driver. The display panel driver includes a timing controller 200, a gate driver 300A, a gamma reference voltage generator 400 and a data driver 500.

The gate driver 300A includes a memory 320, a selector 340 and a plurality of stages 360.

The stages 360 outputs the gate signals to the gate lines GL.

The memory 320 receives a gate input signal applied to at least one of the stages 360, and outputs the gate input signal as a selection signal SEL to the selector 340.

The memory 320 may receive the gate input signal during a non-driving period of the stages 360.

The selector 340 outputs the vertical start signal FLM to the scan start point among the stages based on the selection signal SEL. The selector 340 may output the vertical start signal FLM to the scan start point among the stages during the driving period of the stages 360.

The memory 320 may receive a first gate input signal, a second gate input signal and a third gate input signal and the selector 340 may output the vertical start signal FLM to one of a first start stage corresponding to a first scan start point SP1 of the display panel 100, a second start stage corresponding to a second scan start point SP2 of the display panel 100 and a third start stage corresponding to a third scan start point SP3 of the display panel 100 based on the first gate input signal, the second gate input signal and the third gate input signal.

In the present exemplary embodiment, the first to third gate input signals may be respectively the vertical start signal FLM, a first clock signal SCLK1 and a second clock signal SCLK2. The memory 320 may receive the vertical start signal FLM, the first clock signal SCLK1 and the second clock signal SCLK2.

The memory 320 may include a first memory MEM1 storing the first gate input signal FLM and connected to the first start stage ST1 corresponding to the first scan start point SP1, a second memory MEM2 storing the second gate input signal SCLK1 and connected to the second start stage STP corresponding to the second scan start point SP2 and a third memory MEM3 storing the third gate input signal SCLK2 and connected to the third start stage STQ corresponding to the third scan start point SP3.

The memory 320 may include a first mode switching element TM1 including a control electrode to which the mode selection signal MS is applied, an input electrode to which the first gate input signal FLM is applied and an output electrode connected to the first memory MEM1, a second mode switching element TM2 including a control electrode to which the mode selection signal MS is applied, an input electrode to which the second gate input signal SCLK1 is applied and an output electrode connected to the second memory MEM2 and a third mode switching element TM3 including a control electrode to which the mode selection signal MS is applied, an input electrode to which the third gate input signal SCLK2 is applied and an output electrode connected to the third memory MEM3.

In FIG. 11, for example, the vertical start signal FLM having a low level may be stored in the first memory MEM1 and the first and second clock signals SCLK1 and SCLK2 having a high level may be stored in the second and third memories MEM2 and MEM3 during the first non-driving period. During the driving period right after the first non-driving period, the display panel 100 may be scanned from the first scan start point (SP1=ST1) by the vertical start signal FLM having the low level.

For example, the first clock signal SCLK1 having a low level may be stored in the second memory MEM2 and the vertical start signal FLM and the second clock signals FLM, SCLK2 and SCLK3 having a high level may be stored in the first and third memories MEM1 and MEM3 during a second non-driving period. During the driving period right after the second non-driving period, the display panel 100 may be scanned from the second scan start point (SP2=STP) by the first clock signal SCLK1 having the low level.

According to the present exemplary embodiment, the scan start point SP1, SP2 and SP3 may be set using the input signals FLM, SCLK1 and SCLK2 of the gate driver 300A.

Using the above technical features, the data corresponding to an area of a changing image may be selectively updated in a low frequency driving method so that the power consumption may be reduced.

In addition, the display quality compensation and the lifetime compensation may be applied to a specific portion of the display panel 100 so that the display quality of the display panel 100 may be enhanced and the power consumption may be reduced.

Figure 12:
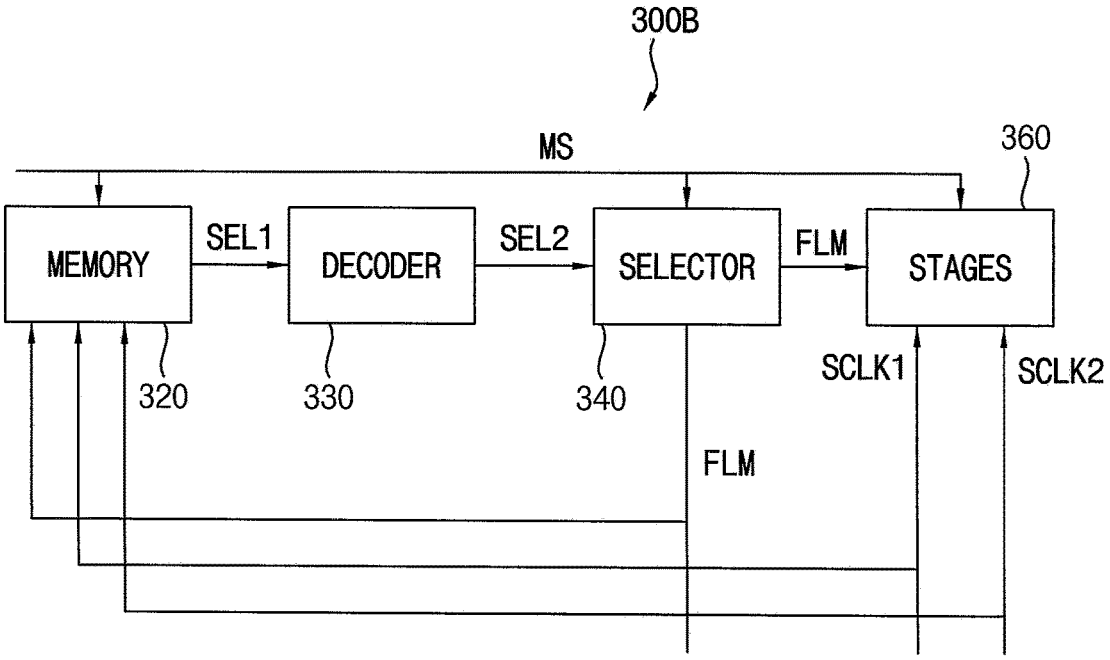
FIG. 12 is a block diagram illustrating a gate driver of a display apparatus according to an exemplary embodiment of the present inventive concept.
Figure 13:
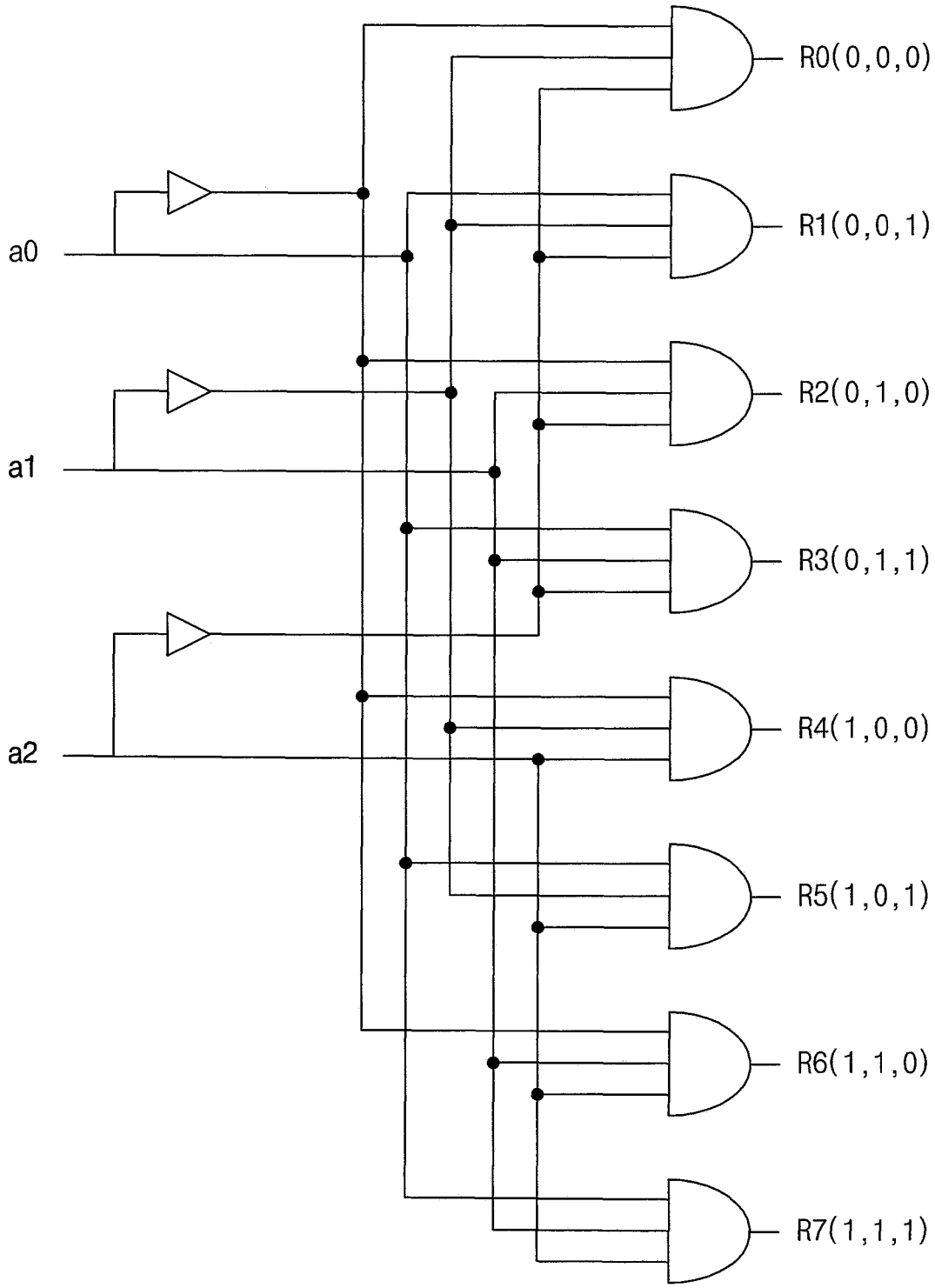
FIG. 13 is a circuit diagram illustrating a decoder of FIG. 12.
Figure 14:
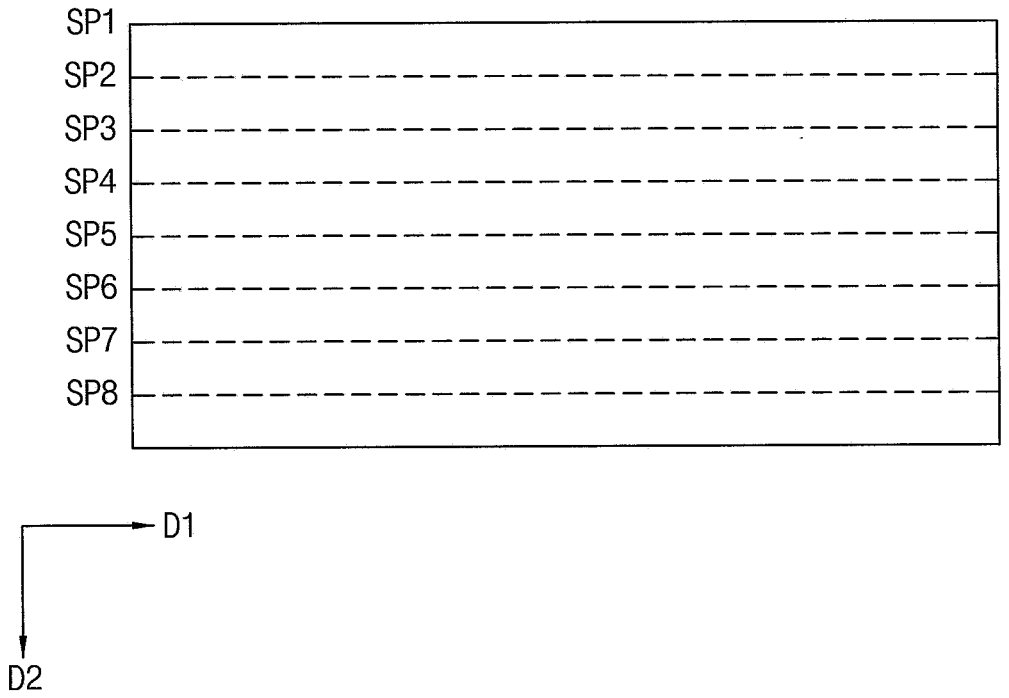
FIG. 14 is a conceptual diagram illustrating a scan start point of a display panel of FIG. 12.

FIG. 12 is a block diagram illustrating a gate driver 300B of a display apparatus according to an exemplary embodiment of the present inventive concept. FIG. 13 is a circuit diagram illustrating a decoder 330 of FIG. 12. FIG. 14 is a conceptual diagram illustrating a scan start point of a display panel 100 of FIG. 12.

The display apparatus according to the present exemplary embodiment is substantially the same as the display apparatus of the previous exemplary embodiment explained in accordance with to FIGS. 1 to 7 except for the structure of the gate driver and the signals applied to the gate driver. Thus, the same reference numerals will be used to refer to the same or like parts as those described in the previous exemplary embodiment of FIGS. 1 to 7 and any repetitive explanation concerning the above elements will be omitted.

Referring to FIGS. 1 and 12 to 14, the display apparatus includes a display panel 100 and a display panel driver. The display panel driver includes a timing controller 200, a gate driver 300B, a gamma reference voltage generator 400 and a data driver 500.

The gate driver 300B includes a memory 320, a decoder 330, a selector 340 and a plurality of stages 360.

The stages 360 outputs the gate signals to the gate lines GL.

The memory 320 receives a gate input signal applied to at least one of the stages 360, and outputs the gate input signal as a selection signal SEL to the decoder 330.

The memory 320 may receive the gate input signal during a non-driving period of the stages 360.

The decoder 330 is disposed between the memory 320 and the selector 340.

The decoder 330 decodes the selection signal SEL1 outputted from the memory 320 to generate a decoded selection signal SEL2. The decoder 330 outputs the decoded selection signal SEL2 to the selector 340.

In the present exemplary embodiment, the memory 320 may receive a first gate input signal FLM (a0), a second gate input signal SCLK1 (a1) and a third gate input signal SCLK2 (a2).

The decoder 330 may output eight decoded signals R0 to R7 based on the first gate input signal a0, the second gate input signal al and a third gate input signal a2. The decoder 330 outputs only one of the eight decoded signals R0 to R7 in a specific moment. The decoder 330 may not output two or more signals among the eight decoded signals R0 to R7 simultaneously. For example, the decoder 330 may include eight OR gates and three inverters.

Alternatively, when the number of the input gate signals is four, the decoder 330 may output sixteen decoded signals. Herein, the decoder 330 may include sixteen OR gates and four inverters.

The selector 340 may output the vertical start signal FLM to one of a first start stage corresponding to a first scan start point SP1 of the display panel 100, a second start stage corresponding to a second scan start point SP2 of the display panel 100, a third start stage corresponding to a third scan start point SP3 of the display panel 100, a fourth start stage corresponding to a fourth scan start point SP4 of the display panel 100, a fifth start stage corresponding to a fifth scan start point SP5 of the display panel 100, a sixth start stage corresponding to a sixth scan start point SP6 of the display panel 100, a seventh start stage corresponding to a seventh scan start point SP7 of the display panel 100 and an eighth start stage corresponding to an eighth scan start point SP8 of the display panel 100 based on the first to eighth decoded signals R0 to R7.

The memory 320 may include a first memory MEM1 storing the first gate input signal FLM, a second memory MEM2 storing the second gate input signal SCLK1 and a third memory MEM3 storing the third gate input signal SCLK2.

The memory 320 may include a first mode switching element TM1 including a control electrode to which the mode selection signal MS is applied, an input electrode to which the first gate input signal FLM is applied and an output electrode connected to the first memory MEM1, a second mode switching element TM2 including a control electrode to which the mode selection signal MS is applied, an input electrode to which the second gate input signal SCLK1 is applied and an output electrode connected to the second memory MEM2 and a third mode switching element TM3 including a control electrode to which the mode selection signal MS is applied, an input electrode to which the third gate input signal SCLK2 is applied and an output electrode connected to the third memory MEM3.

According to the present exemplary embodiment, the scan start point SP1, SP2, SP3, SP4, SP5, SP6, SP7 and SP8 may be set using the input signals FLM, SCLK1 and SCLK2 of the gate driver 300B.

Using the above technical features, the data corresponding to an area of a changing image may be selectively updated in a low frequency driving method so that the power consumption may be reduced.

In addition, the display quality compensation and the lifetime compensation may be applied to a specific portion of the display panel 100 so that the display quality of the display panel 100 may be enhanced and the power consumption may be reduced.

Figure 15:
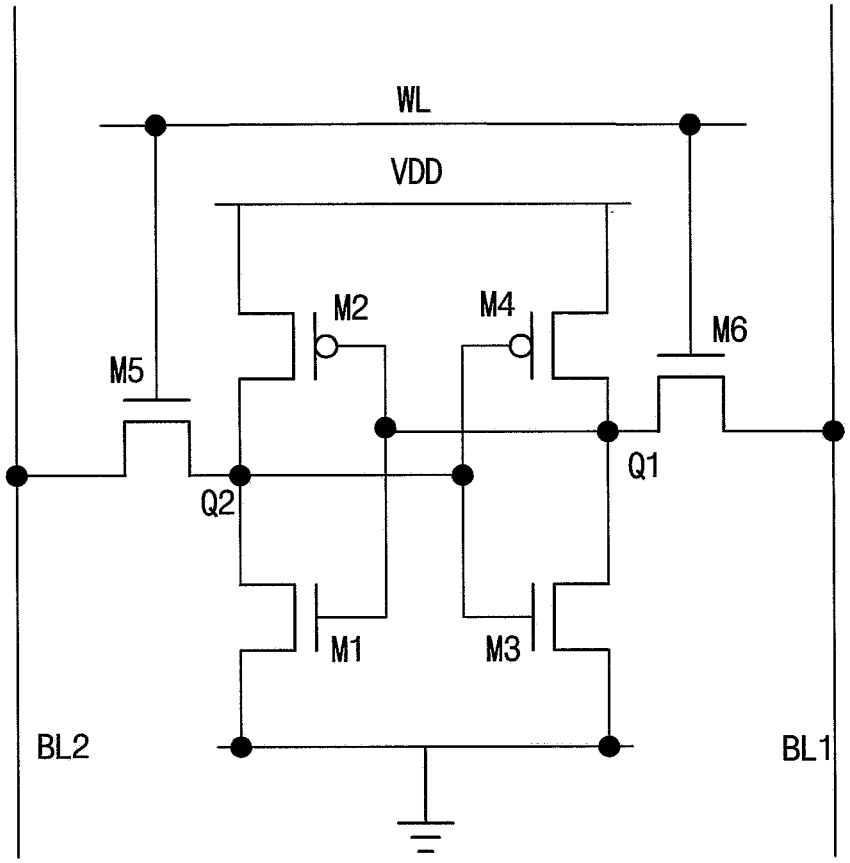
FIG. 15 is a circuit diagram illustrating a memory of a gate driver of a display apparatus according to an exemplary embodiment of the present inventive concept.

FIG. 15 is a circuit diagram illustrating a memory of a gate driver of a display apparatus according to an exemplary embodiment of the present inventive concept.

The display apparatus according to the present exemplary embodiment is substantially the same as the display apparatus of the previous exemplary embodiment explained in accordance with to FIGS. 1 to 7 except for the structure of the memory of the gate driver. Thus, the same reference numerals will be used to refer to the same or like parts as those described in the previous exemplary embodiment of FIGS. 1 to 7 and any repetitive explanation concerning the above elements will be omitted.

Referring to FIGS. 1 to 6 and 15, the display apparatus includes a display panel 100 and a display panel driver. The display panel driver includes a timing controller 200, a gate driver 300, a gamma reference voltage generator 400 and a data driver 500.

The gate driver 300 includes a memory 320, a selector 340 and a plurality of stages 360.

The stages 360 outputs the gate signals to the gate lines GL.

The memory 320 receives a gate input signal applied to at least one of the stages 360, and outputs the gate input signal as a selection signal SEL to the selector 340.

The memory 320 may receive the gate input signal during a non-driving period of the stages 360.

The selector 340 outputs the vertical start signal FLM to the scan start point among the stages based on the selection signal SEL. The selector 340 may output the vertical start signal FLM to the scan start point among the stages during the driving period of the stages 360.

For example, the memory 320 may include an one-bit memory. The one-bit memory may include six memory switching elements M1 to M6.

A first memory switching element M1 includes a control electrode connected to a first node Q1, an input electrode connected to a second node Q2 and an output electrode connected to the ground.

A second memory switching element M2 includes a control electrode connected to the first node Q1, an input electrode to which a power voltage VDD is applied and an output electrode connected to the second node Q2.

A third memory switching element M3 includes a control electrode connected to the second node Q2, an input electrode connected to the first node Q1 and an output electrode connected to the ground.

A fourth memory switching element M4 includes a control electrode connected to the second node Q2, an input electrode to which the power voltage VDD is applied and an output electrode connected to the first node Q1.

A fifth memory switching element M5 includes a control electrode connected to a word line WL, an input electrode connected to a second bit line BL2 and an output electrode connected to the second node Q2.

A sixth memory switching element M6 includes a control electrode connected to the word line WL, an input electrode connected to a first bit line BL1 and an output electrode connected to the first node Q1.

According to the present exemplary embodiment, the scan start point SP1, SP2, SP3 and SP4 may be set using the input signals FLM, SCLK1, SCLK2 and SCLK3 of the gate driver 300.

Using the above technical features, the data corresponding to an area of a changing image may be selectively updated in a low frequency driving method so that the power consumption may be reduced.

In addition, the display quality compensation and the lifetime compensation may be applied to a specific portion of the display panel 100 so that the display quality of the display panel 100 may be enhanced and the power consumption may be reduced.

Figure 16:
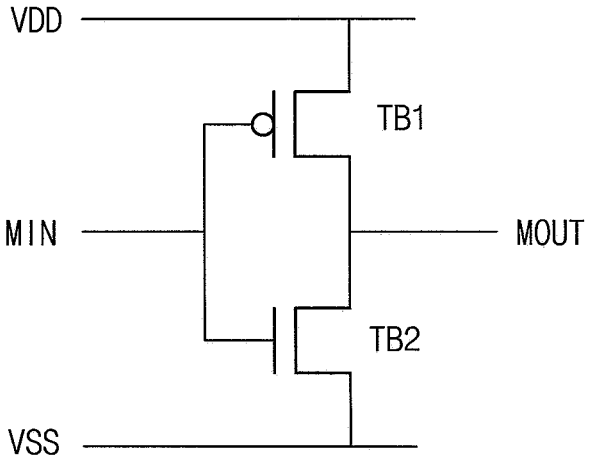
FIG. 16 is a circuit diagram illustrating a memory of a gate driver of a display apparatus according to an exemplary embodiment of the present inventive concept.

FIG. 16 is a circuit diagram illustrating a memory of a gate driver of a display apparatus according to an exemplary embodiment of the present inventive concept.

The display apparatus according to the present exemplary embodiment is substantially the same as the display apparatus of the previous exemplary embodiment explained in accordance with to FIGS. 1 to 7 except for the structure of the memory of the gate driver. Thus, the same reference numerals will be used to refer to the same or like parts as those described in the previous exemplary embodiment of FIGS. 1 to 7 and any repetitive explanation concerning the above elements will be omitted.

Referring to FIGS. 1 to 6 and 16, the display apparatus includes a display panel 100 and a display panel driver. The display panel driver includes a timing controller 200, a gate driver 300, a gamma reference voltage generator 400 and a data driver 500.

The gate driver 300 includes a memory 320, a selector 340 and a plurality of stages 360.

The stages 360 output the gate signals to the gate lines GL.

The memory 320 receives a gate input signal applied to at least one of the stages 360, and outputs the gate input signal as a selection signal SEL to the selector 340.

The memory 320 may receive the gate input signal during a non-driving period of the stages 360.

The selector 340 outputs the vertical start signal FLM to the scan start point among the stages based on the selection signal SEL. The selector 340 may output the vertical start signal FLM to the scan start point among the stages during the driving period of the stages 360.

For example, the memory 320 may include an one-bit memory. The one-bit memory may include two memory switching elements TB1 and TB2.

A first memory switching element TB1 includes a control electrode to which an input signal MIN is applied, an input electrode to which a first power voltage VDD is applied and an output electrode outputting an output signal MOUT.

A second memory switching element TB2 includes a control electrode to which the input signal MIN is applied, an input electrode to which a second power voltage VSS is applied and an output electrode outputting the output signal MOUT.

According to the present exemplary embodiment, the scan start point SP1, SP2, SP3 and SP4 may be set using the input signals FLM, SCLK1, SCLK2 and SCLK3 of the gate driver 300.

Using the above technical features, the data corresponding to an area of a changing image may be selectively updated in a low frequency driving method so that the power consumption may be reduced.

In addition, the display quality compensation and the lifetime compensation may be applied to a specific portion of the display panel 100 so that the display quality of the display panel 100 may be enhanced and the power consumption may be reduced.

Figure 17:
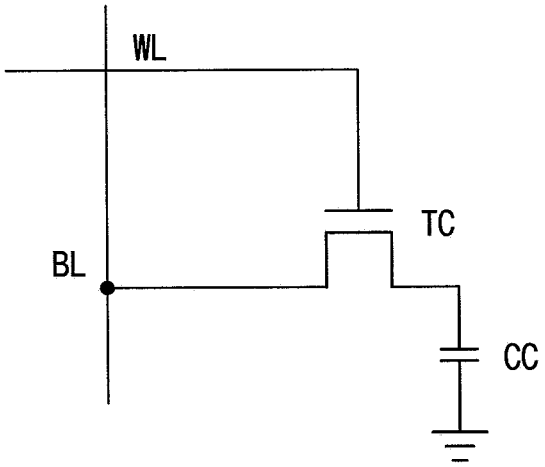
FIG. 17 is a circuit diagram illustrating a memory of a gate driver of a display apparatus according to an exemplary embodiment of the present inventive concept.

FIG. 17 is a circuit diagram illustrating a memory of a gate driver of a display apparatus according to an exemplary embodiment of the present inventive concept.

The display apparatus according to the present exemplary embodiment is substantially the same as the display apparatus of the previous exemplary embodiment explained in accordance with to FIGS. 1 to 7 except for the structure of the memory of the gate driver. Thus, the same reference numerals will be used to refer to the same or like parts as those described in the previous exemplary embodiment of FIGS. 1 to 7 and any repetitive explanation concerning the above elements will be omitted.

Referring to FIGS. 1 to 6 and 17, the display apparatus includes a display panel 100 and a display panel driver. The display panel driver includes a timing controller 200, a gate driver 300, a gamma reference voltage generator 400 and a data driver 500.

The gate driver 300 includes a memory 320, a selector 340 and a plurality of stages 360.

The stages 360 output the gate signals to the gate lines GL.

The memory 320 receives a gate input signal applied to at least one of the stages 360, and outputs the gate input signal as a selection signal SEL to the selector 340.

The memory 320 may receive the gate input signal during a non-driving period of the stages 360.

The selector 340 outputs the vertical start signal FLM to the scan start point among the stages based on the selection signal SEL. The selector 340 may output the vertical start signal FLM to the scan start point among the stages during the driving period of the stages 360.

For example, the memory 320 may include an one-bit memory. The one-bit memory may include a memory switching element TC and a capacitor CC.

A first memory switching element TC includes a control electrode connected to a word line WL, an input electrode connected to a bit line BL and an output electrode connected to a first electrode of the capacitor CC.

The capacitor includes the first electrode connected to the output electrode of the first memory switching element TC and a second electrode connected to the ground.

According to the present exemplary embodiment, the scan start point SP1, SP2, SP3 and SP4 may be set using the input signals FLM, SCLK1, SCLK2 and SCLK3 of the gate driver 300.

Using the above technical features, the data corresponding to an area of a changing image may be selectively updated in a low frequency driving method so that the power consumption may be reduced.

In addition, the display quality compensation and the lifetime compensation may be applied to a specific portion of the display panel 100 so that the display quality of the display panel 100 may be enhanced and the power consumption may be reduced.

According to the exemplary embodiments of the gate driver, the display apparatus and the method of driving the display panel, the scan start point of the display panel may be determined. Thus, the power consumption of the display apparatus may be reduced and the display quality of the display panel may be enhanced.

The foregoing is illustrative of the present inventive concept and is not to be construed as limiting thereof. Although a few exemplary embodiments of the present inventive concept have been described, those skilled in the art will readily appreciate that many modifications are possible in the exemplary embodiments without materially departing from the novel teachings and advantages of the present inventive concept. Accordingly, all such modifications are intended to be included within the scope of the present inventive concept as defined in the claims and equivalents thereof. In the claims, means-plus-function clauses are intended to cover the structures described herein as performing the recited function and not only structural equivalents but also equivalent structures. Therefore, it is to be understood that the foregoing is illustrative of the present inventive concept and is not to be construed as limited to the specific exemplary embodiments disclosed, and that modifications to the disclosed exemplary embodiments, as well as other exemplary embodiments, are intended to be included within the scope of the appended claims and equivalents thereof. The present inventive concept is defined by the following claims, with equivalents of the claims to be included therein.

What is claimed is:

1. A gate driver comprising:

a plurality of stages to provide a plurality of gate signals to a plurality of gate lines;

a memory to receive and store a gate input signal to be applied to at least one of the stages and to output the gate input signal as a selection signal; and a selector to output a vertical start signal to a scan start point among the stages based on the selection signal, wherein the memory comprises:

a first memory to store a first gate input signal to be applied to at least one of the stages and connected to a first start stage corresponding to a first scan start point; and a second memory to store a second gate input signal to be applied to at least one of the stages and connected to a second start stage corresponding to a second scan start point.

2. The gate driver of claim 1, wherein the memory is to receive the gate input signal during a non-driving period of the stages.

3. The gate driver of claim 2, wherein the memory further comprises:

a first mode switching element comprising a control electrode to which a mode selection signal is to be applied, an input electrode to which the first gate input signal is to be applied and an output electrode connected to the first memory; and a second mode switching element comprising a control electrode to which the mode selection signal is to be applied, an input electrode to which the second gate input signal is to be applied and an output electrode connected to the second memory.

4. The gate driver of claim 3, wherein the mode selection signal turns on the first mode switching element and the second mode switching element in the non-driving period of the stages.

5. The gate driver of claim 2, wherein the selector comprises a first selection switching element comprising a control electrode connected to the memory, an input electrode to which the vertical start signal is to be applied and an output electrode connected to a present stage among the stages.

6. The gate driver of claim 5, wherein the selector further comprises a second selection switching element comprising a control electrode connected to the memory, an input electrode connected to a previous stage among the stages and an output electrode connected to the present stage among the stages.

7. The gate driver of claim 6, wherein the first selection switching element and the second selection switching element are alternately and exclusively turned on and off.

8. The gate driver of claim 6, wherein the selector further comprises a third mode switching element comprising a control electrode to which a mode selection signal is to be applied, an input electrode to which the vertical start signal is to be applied and an output electrode connected to the first selection switching element.

9. The gate driver of claim 2, further comprising a fourth mode switching element comprising a control electrode to which a mode selection signal is to be applied, an input electrode to which the gate input signal is to be applied and an output electrode connected to the stages.

10. The gate driver of claim 2, further comprising a decoder arranged between the memory and the selector, and wherein the decoder is to decode the selection signal outputted from the memory and to output the decoded selection signal to the selector.

11. The gate driver of claim 2, wherein the memory is to receive a plurality of gate input signals, and wherein the gate input signals include the vertical start signal, a first clock signal and a second clock signal.

12. A display apparatus comprising:

a gate driver comprising a plurality of stages to provide a plurality of gate signals to a plurality of gate lines, a memory to receive and store a gate input signal to be applied to at least one of the stages and to output the gate input signal as a selection signal and a selector to output a vertical start signal to a scan start point among the stages based on the selection signal;

a data driver to output a plurality of data voltages to a plurality of data lines; and a display panel to display an image based on the gate signals and the data voltages, wherein the memory comprises:

a first memory to store a first gate input signal to be applied to at least one of the stages and connected to a first start stage corresponding to a first scan start point; and a second memory to store a second gate input signal to be applied to at least one of the stages and connected to a second start stage corresponding to a second scan start point.

13. The display apparatus of claim 12, wherein the memory is to receive the gate input signal during a non-driving period of the stages.

14. The display apparatus of claim 13, wherein the memory is to receive the first gate input signal, the second gate input signal and a third gate input signal, and wherein the selector is to output the vertical start signal to one of the first start stage corresponding to the first scan start point of the display panel, the second start stage corresponding to the second scan start point of the display panel and a third start stage corresponding to a third scan start point of the display panel based on the first gate input signal, the second gate input signal and the third gate input signal.

15. The display apparatus of claim 13, wherein the memory is to receive the first gate input signal, the second gate input signal, a third gate input signal and a fourth gate input signal, and wherein the selector is to output the vertical start signal to one of the first start stage corresponding to the first scan start point of the display panel, the second start stage corresponding to the second scan start point of the display panel, a third start stage corresponding to a third scan start point of the display panel and a fourth start stage corresponding to a fourth scan start point of the display panel based on the first gate input signal, the second gate input signal, the third gate input signal and the fourth gate input signal.

16. The display apparatus of claim 13, wherein the gate driver further comprises a decoder arranged between the memory and the selector, and wherein the decoder is to decode the selection signal outputted from the memory and to output the decoded selection signal to the selector.

17. The display apparatus of claim 16, wherein the memory is to receive the first gate input signal, the second gate input signal and a third gate input signal, wherein the decoder is to generate a decoded selection signal based on the first gate input signal, the second gate input signal and the third gate input signal, and wherein the selector outputs the vertical start signal to one of the first start stage corresponding to the first scan start point of the display panel, the second start stage corresponding to the second scan start point of the display panel, a third start stage corresponding to a third scan start point of the display panel, a fourth start stage corresponding to a fourth scan start point of the display panel, a fifth start stage corresponding to a fifth scan start point of the display panel, a sixth start stage corresponding to a sixth scan start point of the display panel, a seventh start stage corresponding to a seventh scan start point of the display panel and an eighth start stage corresponding to an eighth scan start point of the display panel based on the decoded selection signal.

18. A method of driving a display panel, the method comprising:

receiving and storing a gate input signal in a memory, the gate input signal applied to at least one of a plurality of stages of a gate driver;

outputting the gate input signal as a selection signal;

determining a scan start point among the stages based on the gate input signal;

storing a first gate input signal in a first memory connected to a first stage corresponding to a first scan start point, the first gate input signal applied to at least one of the stages;

storing a second gate input signal in a second memory connected to a second start stage corresponding to a second scan start point, the second gate input signal applied to at least one of the stages;

outputting gate signals to the display panel from the scan start point;

outputting data voltages to the display panel; and outputting an image based on the gate signals and the data voltages.

19. The method of claim 18, wherein the memory receives the gate input signal during a non-driving period of the stages.

* * * * *